US009593530B1

(12) United States Patent
Anthony et al.

(10) Patent No.: US 9,593,530 B1
(45) Date of Patent: Mar. 14, 2017

(54) BRAKE ASSEMBLY FOR A COVERING FOR AN ARCHITECTURAL OPENING

(71) Applicant: Hunter Douglas Inc., Pearl River, NY (US)

(72) Inventors: James M. Anthony, Denver, CO (US); Daniel Fluckey, Denver, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/829,414

(22) Filed: Aug. 18, 2015

(51) Int. Cl.
*E06B 9/90* (2006.01)
*E06B 9/80* (2006.01)
*E06B 9/44* (2006.01)

(52) U.S. Cl.
CPC ..... *E06B 9/80* (2013.01); *E06B 9/44* (2013.01); *E06B 2009/905* (2013.01)

(58) Field of Classification Search
CPC ..... E06B 2009/905; E06B 9/80; E06B 9/44
USPC ..... 160/307, 296, 308, 323.1
See application file for complete search history.

(56) References Cited

U.S. PATENT DOCUMENTS 4,372,432 A * 2/1983 Waine ..... E06B 9/78 160/307
4,498,517 A * 2/1985 Mase ..... E06B 9/82 160/294
4,535,830 A * 8/1985 Appel ..... E06B 9/90 160/299
4,779,662 A * 10/1988 Wilk ..... E06B 9/90 160/298
4,865,109 A * 9/1989 Sherman ..... E06B 9/78 160/277
5,361,822 A * 11/1994 Nijs ..... E06B 9/78 160/298
5,542,464 A * 8/1996 Shiina ..... E06B 9/56 160/296
5,669,432 A * 9/1997 Nisenson ..... E06B 9/68 160/307
5,927,370 A * 7/1999 Judkins ..... E06B 9/262 160/291
6,283,192 B1 9/2001 Toti
6,293,329 B1 9/2001 Toti
6,536,503 B1 3/2003 Anderson et al.
6,644,372 B2 11/2003 Judkins
6,648,050 B1 11/2003 Toti
6,957,683 B2 10/2005 Toti
6,968,884 B2 11/2005 Anderson et al.
(Continued)

*Primary Examiner* — David Purol
(74) *Attorney, Agent, or Firm* — Dorsey & Whitney LLP

(57) ABSTRACT

A covering for an architectural opening may include a brake assembly including a first housing, a clutch on which the first housing may be mounted, a sleeve, a second housing attached to the sleeve, and a spring element attached to the second housing. The brake assembly may permit relatively unrestricted rotation of the first housing in a first direction, and impart rotational resistance to rotation of the first housing in a second direction. A method for assembling a covering for an architectural opening may include coupling a clutch to a first housing, coupling the clutch to a sleeve, coupling a second housing to the sleeve, mounting the second housing over a hub, and positioning a torsion spring between the hub and the second housing. The brake assembly may be used to impart rotational resistance to extension of a shade member, such as to resist unintended extension of the shade member.

22 Claims, 11 Drawing Sheets

(56) References Cited

U.S. PATENT DOCUMENTS

| | | | | |
|---|---|---|---|---|
| 7,100,668 | B2 * | 9/2006 | Allsop | E06B 9/56 160/321 |
| 7,117,919 | B2 | 10/2006 | Judkins | |
| 7,311,133 | B2 | 12/2007 | Anderson et al. | |
| 7,677,293 | B2 * | 3/2010 | Allsopp | E06B 9/50 160/321 |
| 7,802,608 | B2 | 9/2010 | Anderson et al. | |
| 8,230,896 | B2 | 7/2012 | Anderson et al. | |
| 8,708,024 | B2 | 4/2014 | Toti et al. | |
| 8,720,525 | B2 | 5/2014 | Toti et al. | |
| 8,739,853 | B2 | 6/2014 | Judkins | |
| 8,887,788 | B2 | 11/2014 | Toti et al. | |
| 2006/0144527 | A1 | 7/2006 | Toti | |
| 2013/0199735 | A1 | 8/2013 | Colson et al. | |

* cited by examiner

BRAKE ASSEMBLY FOR A COVERING FOR AN ARCHITECTURAL OPENING

FIELD

The present disclosure relates generally to coverings for architectural openings, and more particularly to a brake assembly for a covering for an architectural opening

BACKGROUND

Coverings for architectural openings, such as windows, doors, archways, and the like, have taken numerous forms for many years. Some coverings include a shade member that is extendable and retractable across an architectural opening. To retain the shade member in a desired position, some coverings include one or more counterbalance devices, such as one or more springs and/or drive mechanisms, that resist extension of the shade member.

Commercially-available counterbalance devices typically are provided with standard torque ratings, such as the holding torque of an electric motor or a torque output of a torsion spring. The weight of a shade member and a rail attached to the shade member often do not match the torque rating of commercially-available counterbalance devices. Manufacturers sometimes use a commercially-available counterbalance device with a torque rating that is stronger than the holding torque requirements of the covering, but this approach typically is relatively expensive and results in a spring or drive mechanism that is stronger than required. Manufacturers sometimes use a commercially-available counterbalance device with a torque rating that is weaker than the holding torque requirement of the covering, but this approach may not be effective because the torque of the counterbalance device is generally insufficient to restrain the shade member in a desired position without slippage. Manufacturers sometimes use a custom counterbalance device having the particular torque rating needed for each different covering, but this approach is expensive and generally not economical for mass production.

SUMMARY

Embodiments of the disclosure generally provide a brake assembly for use with a covering for an architectural opening employing a counterbalance device with a torque rating that is weaker than a holding torque requirement of the covering. The brake assembly rotates freely in a direction associated with retraction of an associated shade member and provides slip resistance in a direction associated with extension of the shade member. The brake assembly offsets gravity imbalances in the covering to retain the shade member in a desired position while not adversely affecting retraction of the shade member. The brake assembly may be used with various types of coverings, including roller shades, stacking shades, cordless shades, and corded shades.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, individual aspects of any embodiment can be claimed separately or in combination with aspects and features of that embodiment or any other embodiment.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. The claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate embodiments of the disclosure and, together with the general description given above and the detailed description given below, serve to explain the principles of these embodiments.

DETAILED DESCRIPTION

Illustrative embodiments of the present invention provide a brake assembly for use in a covering for an architectural opening. The brake assembly of the illustrative embodiments supplements the holding torque of a counterbalance device to limit creep of a shade member, thereby retaining the shade member in a desired extended position. By offsetting counterbalance inadequacies in the covering, the brake assembly reduces the time and cost to manufacture the covering, because perfect balance is not required between the holding torque of a counterbalance device and the weight of a shade member and a rail attached to the shade member. Example counterbalance devices include, but are not limited to, springs, drive mechanisms, or other devices providing torque that resists extension of a shade member across an architectural opening. Example drive mechanisms include, but are not limited to, a drive pulley and operating element, an electric motor, or any other drive mechanism suitable to retract a shade member across an architectural opening. In coverings using a motor, the brake assembly of the illustrative embodiments may offset at least a portion of the load required to hold the shade member and the rail in a desired extended position from the motor, thereby reducing wear and tear of the motor.

The brake assembly of the illustrative embodiments may be used in combination with a commercially-available counterbalance device having a standard torque rating that is weaker than the torque needed for a given covering, thereby supplementing the torque of the counterbalance device and providing the desired counterbalancing torque, resulting in a more economical covering without sacrificing functionality. The brake assembly of the illustrative embodiments rotates freely in a first direction corresponding to retraction of a shade member so that the brake assembly does not affect retraction of the shade member. The brake assembly of the illustrative embodiments resists rotation in a second direction corresponding to extension of the shade member to resist undesired further extension of the shade member when no force is applied to the shade. The brake assembly of the illustrative embodiments can be used with various types of coverings, such as roller shades, stacking shades, cordless shades, and corded shades.

Figure 1:
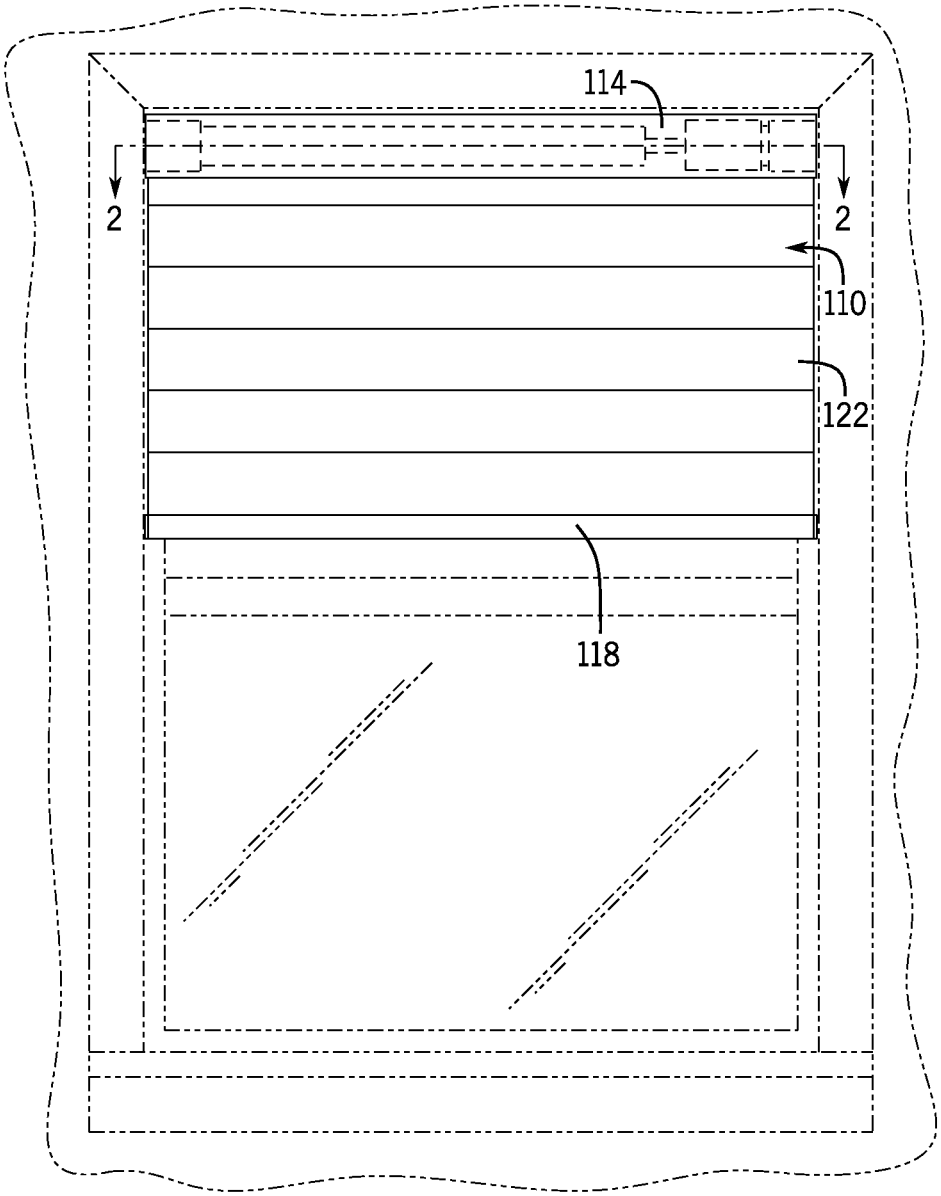
FIG. 1 is an elevational view of a covering extended partially across a window opening in accordance with some embodiments of the present disclosure.

FIGS. 1-10 illustrate an exemplary embodiment of a brake assembly used in association with an illustrative example of a roller shade. Covering 110, illustrated in FIG. 1, is shown in a partially extended position across a window opening in accordance with some embodiments of the present disclosure. The covering 110 of the illustrative embodiment includes a head rail 114, a movable rail 118, and a shade member 122 extending between the head rail 114 and the movable rail 118. The rail 118 of the illustrative embodiment is coupled to a lower edge of the shade member 122 and functions as a ballast to maintain the shade member 122 in an extended configuration.

Figure 2:
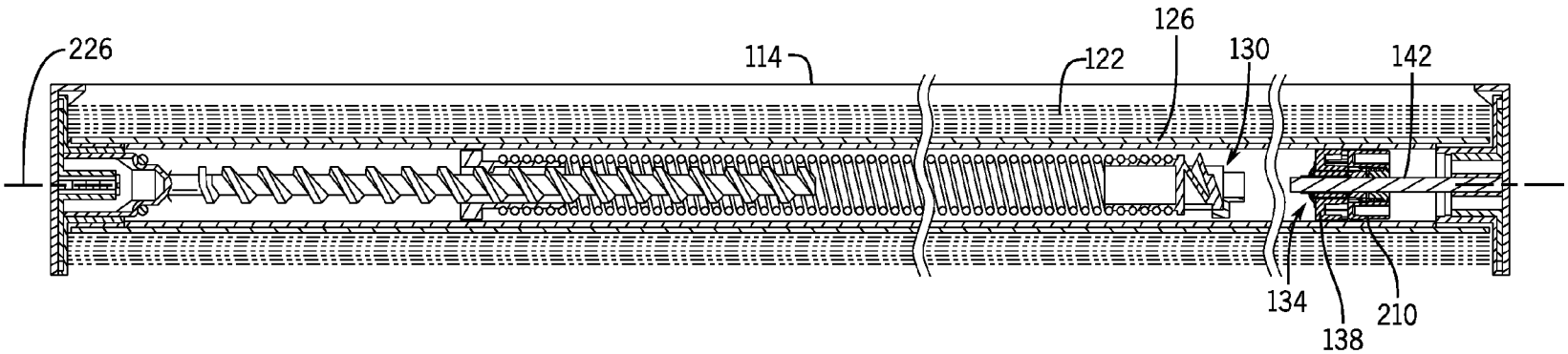
FIG. 2 is a fragmentary lengthwise cross-sectional view of a head rail of the covering of FIG. 1 taken along section line 2-2 of FIG. 1 in accordance with some embodiments of the present disclosure.

As shown in FIG. 2, the illustrative shade member 122 is a roller shade and is coupled to and wrappable about a roller 126. The illustrative roller 126 is formed as a tube, which may have a generally circular cylindrical profile. The covering 110 of FIG. 2 includes a counterbalance device 130, such as the counterbalance spring assembly described in U.S. Patent Publication Number 2014/0216666 A1, which is hereby incorporated by reference herein in its entirety for all purposes. The counterbalance device 130 of the illustrated embodiment is designed to substantially counterbalance the weight of the movable rail 118 and an effective portion of the shade member 122 extended from the roller 126 to retain the shade member 122 in a desired position across the architectural opening.

Referring still to FIG. 2, the covering 110 of the illustrative embodiment includes a brake assembly 134 designed to supplement the holding torque of a counterbalance device, such as that generated by counterbalance device 130, to ensure the shade member 122 is retained in a desired extended position. The brake assembly 134 of the illustrated embodiment is coupled with the roller 126. The brake assembly 134 of the illustrative embodiment resists rotation of the roller 126 in a shade extension direction to retain the shade member 122 in a desired extended position, while providing preferably little to no rotational resistance to the roller 126 in a shade retraction direction so as to not increase the torque load on the counterbalance device 130 during retraction of the shade member 122.

Figure 3:
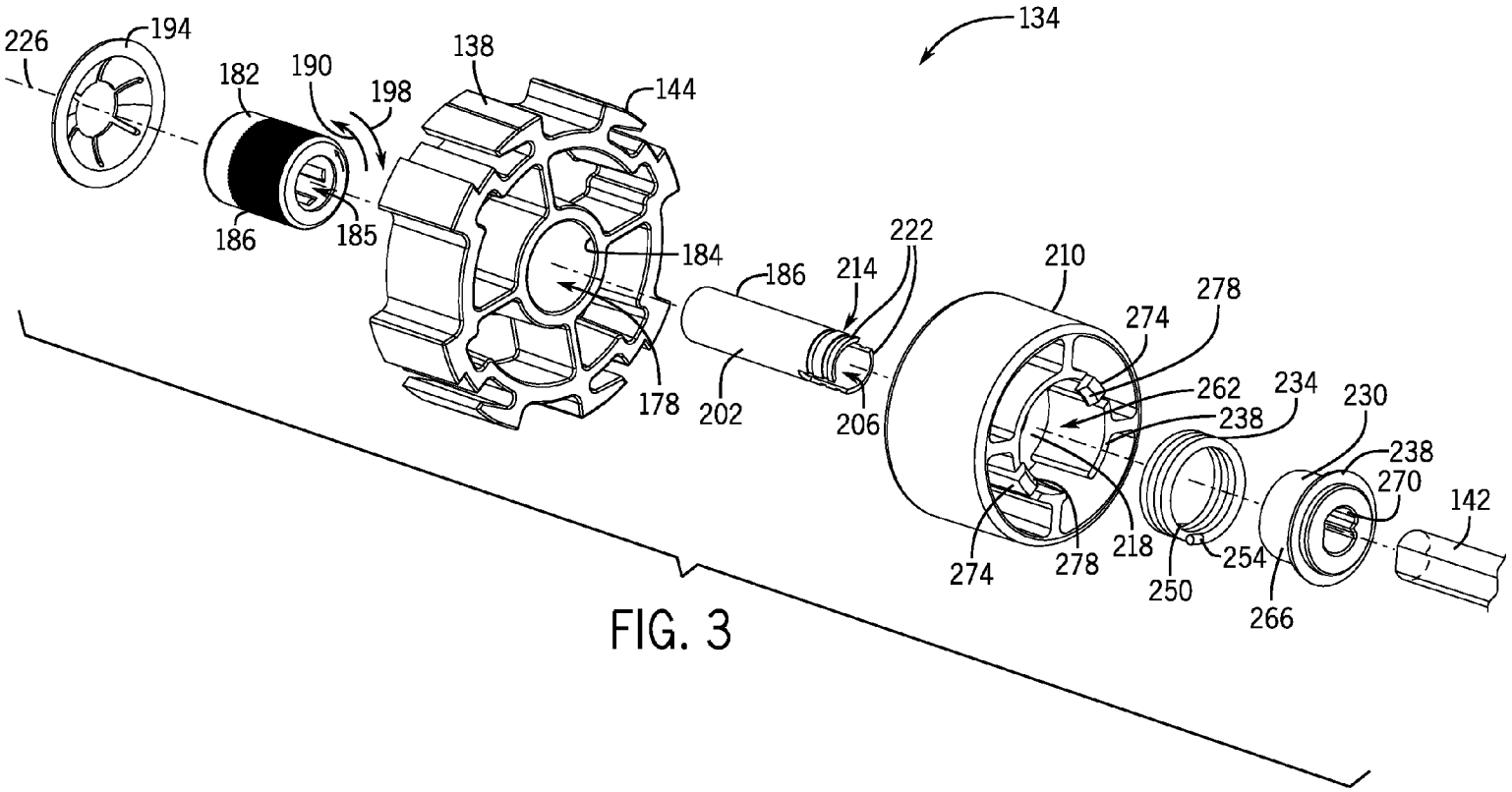
FIG. 3 is a fragmentary exploded view of an exemplary embodiment of a brake assembly.
Figure 9:
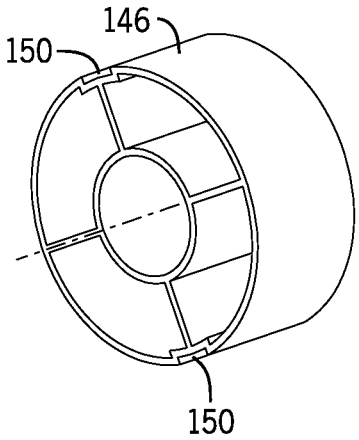
FIG. 9 is an isometric view of an alternative brake driver in accordance with some embodiments of the present disclosure.
Figure 10:
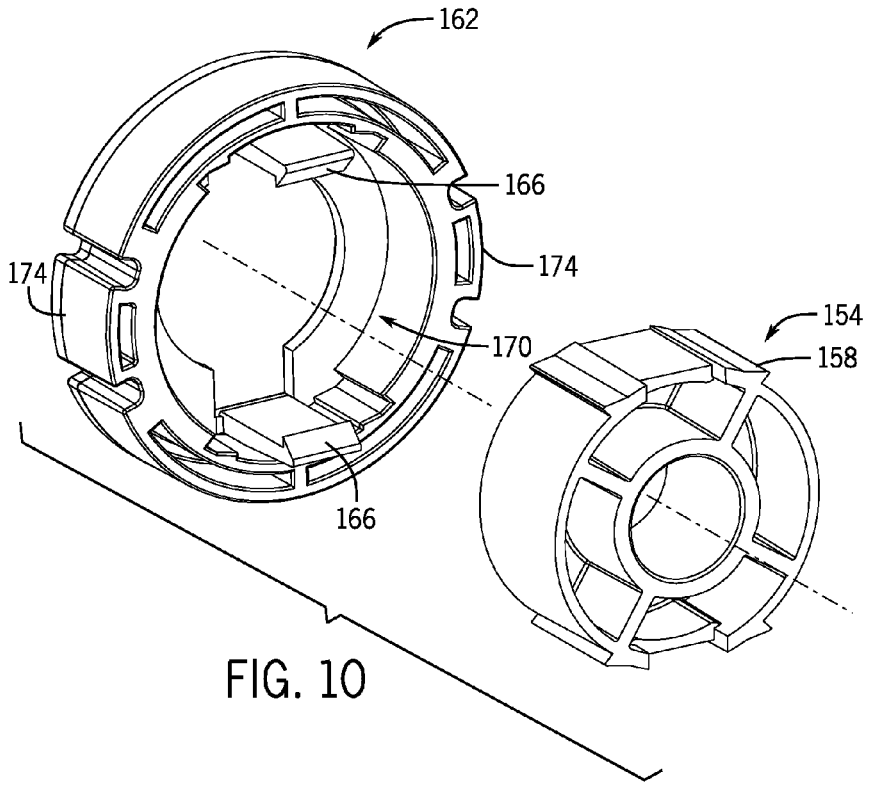
FIG. 10 is an exploded view of another alternative brake driver and an adapter of a brake assembly in accordance with some embodiment of the present disclosure.

FIG. 3 is a fragmentary exploded view of an illustrative embodiment of the brake assembly 134 in accordance with principles of the present invention. Referring to FIGS. 2 and 3, the brake assembly 134 of the illustrated embodiment includes a first housing or brake driver 138 ("brake driver" hereinafter for the sake of convenience without intent to limit) and a non-rotatable shaft 142. The roller 126 of FIG. 2 of the illustrated embodiment is mounted on the brake driver 138 so that the roller 126 and the brake driver 138 rotate in unison. The brake driver 138 of the illustrated embodiment has an outer dimension sized to engage an inner surface of the roller 126. Referring to FIG. 3, the brake driver 138 may include formations 144 formed along an outer surface of the brake driver 138 that interface with corresponding formations of the roller 126, such as in a keyed arrangement, to couple the brake driver 138 and the roller 126 of FIG. 2 together. Other arrangements are within the scope of the present disclosure. For example, an alternative brake driver 146 is illustrated in FIG. 9 and includes formations 150 formed in a peripheral surface of the brake driver 146 for engagement with a roller. Another alternative brake driver 154 is illustrated in FIG. 10 and includes formations 158 formed along a peripheral surface of the brake driver 154 for engagement with a roller. In the embodiment illustrated in FIG. 10, an adapter 162 may be attached to the brake driver 154 for use with larger diameter rollers. The adapter 162 may include one or more latch fingers 166 to retain the brake driver 154 within an interior space 170 of the adapter 162 and one or more formations 174 formed in a peripheral surface of the adapter 162 for engagement with a roller. The brake driver 138 of the illustrative embodiment is operatively coupled to the non-rotatable shaft 142 so that the brake driver 138 is rotatable relative to the non-rotatable shaft 142 in a retraction direction of the roller 126 of FIG. 2, preferably providing little to no resistance to the roller 126 during retraction of the shade member 122.

Figure 6:
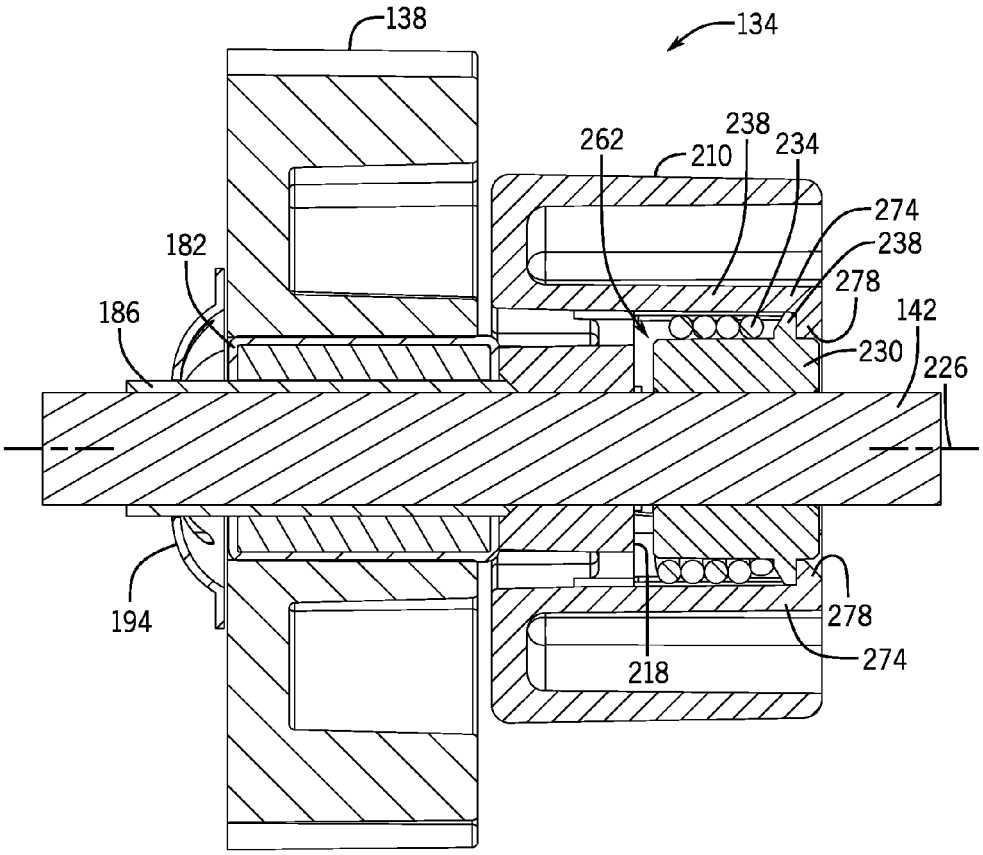
FIG. 6 is a lengthwise sectional view of the brake assembly of FIG. 3 taken along section line 6-6 of FIG. 4 in accordance with some embodiments of the present disclosure.

In the embodiment of FIG. 3, the brake driver 138 defines an interior space 178 for receiving a unidirectional bearing or clutch 182. Referring to FIGS. 3 and 6, an inner surface 184 of the brake driver 138 and an outer surface 186 of the clutch 182 may be engaged with each other so that the brake driver 138 and the clutch 182 rotate in unison with each other. The outer surface 186 of the clutch 182 may include surface features, such as knurling, to enhance the engagement between the brake driver 138 and the clutch 182.

The clutch 182 of the illustrated embodiment supports the brake driver 138 and defines an interior space 185 for receiving a sleeve 186. Referring to FIG. 3, the sleeve 186 may be formed as a tube defining an outer bearing surface 202 for supporting the clutch 182 and defining an interior space 206 for receiving the non-rotatable shaft 142, thereby serving, in this embodiment, to mount the brake driver 138 on the shaft 142. The illustrative clutch 182 is arranged to rotate relative to the sleeve 186 in a retraction direction 190 corresponding to retraction of the shade member 122 of FIG. 1. The roller 126 is mounted on the brake driver 138 to rotate therewith. Thus, during rotation of the roller 126 to retract the shade member 122 of FIG. 1, the brake driver 138 and the clutch 182 of FIG. 3 rotate about the sleeve 186 in unison with the roller 126 in the retraction direction 190, preferably with little to no resistance to rotation of the roller 126, thereby not increasing the torque load on the counterbalance device 130 during retraction of the shade member 122 of FIG. 2. As illustrated in FIGS. 3 and 6, the clutch 182 and the brake driver 138 may be axially secured to the sleeve 186 by a fastener 194, such as a push nut or other type of fastener.

In accordance with one aspect of the illustrated brake assembly 134, the unidirectional clutch 182 of the illustrative embodiment is mounted onto the sleeve 186 such that the clutch 182 locks onto and drivingly rotates with the sleeve 186 in an extension direction 198 corresponding to extension of the shade member 122 of FIG. 2. In the illustrative embodiment of FIG. 3, the clutch 182 includes rollers that contact the bearing surface 202 of the sleeve 186 and lock when the clutch 182 is rotated in the extension direction 198 to inhibit rotation of the clutch 182 relative to the sleeve 186 in the extension direction 198. Thus, in an embodiment in which the brake driver 138 rotates in unison with the clutch 182, the brake driver 138 also locks onto and drivingly rotates with the sleeve 186 in the extension direction 198 corresponding to extension of the shade member 122 of FIG. 2.

A second housing or spring driver 210 ("spring driver" hereinafter for the sake of convenience without intent to limit) is operatively coupled to the brake driver 138, such as via the sleeve 186, to impart rotational resistance to the roller 126 of FIG. 2 in the extension direction 198, thereby supplementing a holding torque of the counterbalance device 130 to retain the shade member 122 of FIG. 2 in a desired position. In the embodiment of FIG. 3, the spring driver 210 of the illustrative embodiment has a smaller outer dimension than the brake driver 138 and is sized to fit within the interior space of the roller 126 without engaging the roller during rotation of the roller. Thus, the operational effect of the spring driver 210 on the roller 126 preferably is limited to operation via the brake driver 138, and the spring driver 210 preferably does not directly impart resistance to rotation of the roller 126.

Figure 5:
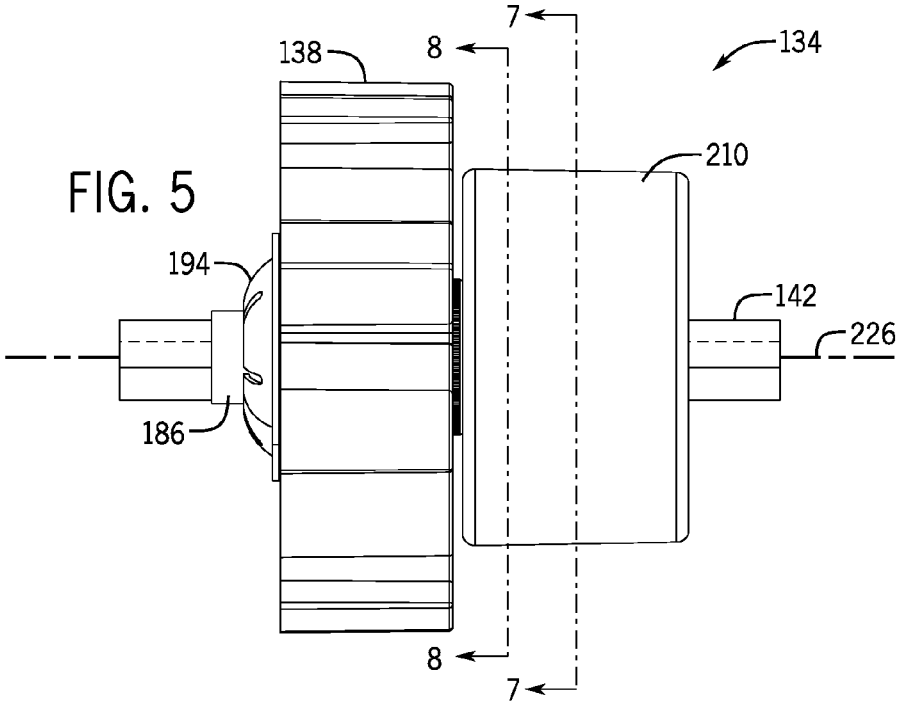
FIG. 5 is an elevational view of the brake assembly of FIG. 3 in accordance with some embodiments of the present disclosure.
Figure 8:
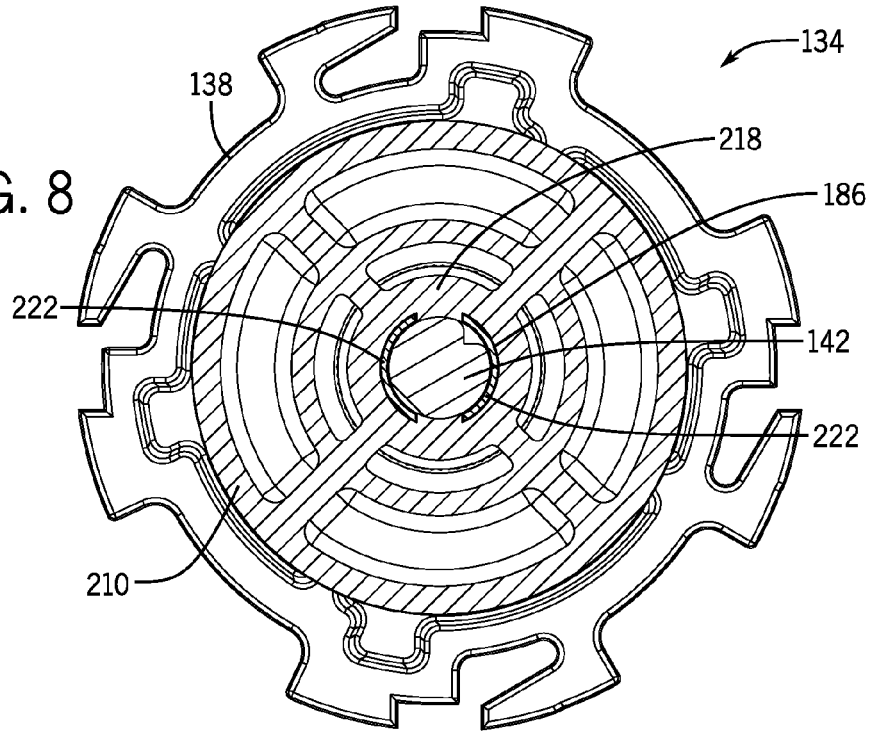
FIG. 8 is a transverse sectional view of the brake assembly of FIG. 3 taken along section line 8-8 of FIG. 5 in accordance with some embodiments of the present disclosure.

The spring driver 210 of the illustrated embodiment is secured to the sleeve 186 so that the spring driver 210 and the sleeve 186 rotate in unison with each other. Thus, when the brake driver 138 is locked onto and drivingly rotates with the sleeve 186 via the clutch 182, the brake driver 138 is affected by the braking operation of the spring driver 210, as will be described in further detail below. The spring driver 210 may be secured to the sleeve 186 by one or more surface features 214 formed on the sleeve 186. Corresponding surface features of the spring driver 210 may cooperate with the surface features 214 of the sleeve 186 to secure the spring driver 210 to the sleeve 186. Referring to FIGS. 6 and 8, the sleeve 186 may be non-rotatably attached to an end wall 218 of the spring driver 210. Referring to FIG. 8, the sleeve 186 may include one or more axially-extending prongs 222 that are peripherally spaced apart from each other. The prongs 222 may be received in and interlock with the end wall 218 of the spring driver 210 so that the sleeve 186 and the spring driver 210 rotate in unison with each other. Although the spring driver 210 and the sleeve 186 are shown as two separate parts, in some embodiments the spring driver 210 and the sleeve 186 are formed as a single, unitary part. As shown in FIG. 5, the spring driver 210 and the brake driver 138 may be arranged axially along the length of the shaft 142. The shaft 142, the sleeve 186, the spring driver 210, and the brake driver 138 may be axially aligned with one another along a longitudinal axis 226 of the brake assembly 134. The spring driver 210 and the brake driver 138 may be positioned end-to-end along the length of the shaft 142 to reduce the axial length of the brake assembly 134.

Referring to FIGS. 3 and 6, the sleeve 186 and the spring driver 210 of the illustrated embodiment are operatively mounted on the non-rotatable shaft 142 via a hub 230 and a spring 234. The hub 230 and the spring 234 of the illustrated embodiment are arranged to resist rotation of the sleeve 186 and the spring driver 210 in the extension direction 198, which resistive force is transferred to the roller 126 through the clutch 182 and the brake driver 138.

Figure 4:
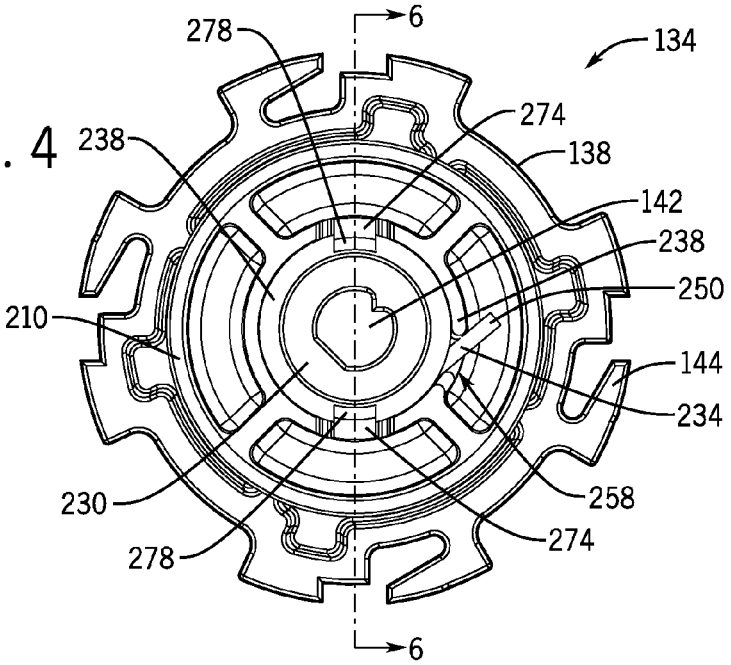
FIG. 4 is an end view of the brake assembly of FIG. 3 in accordance with some embodiments of the present disclosure.
Figure 7:
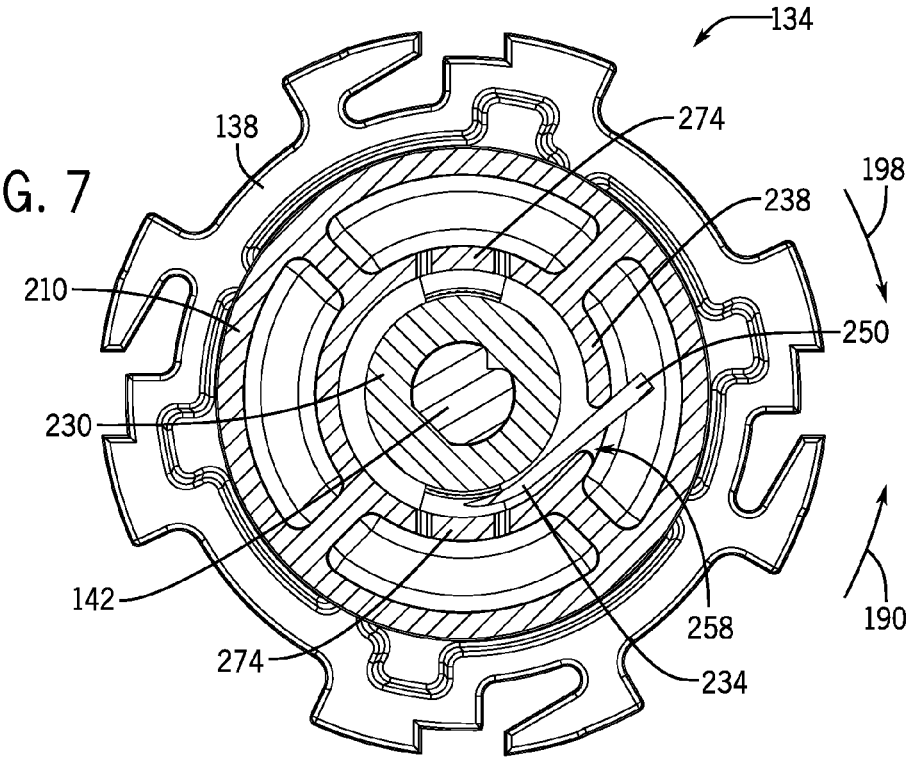
FIG. 7 is a transverse sectional view of the brake assembly of FIG. 3 taken along section line 7-7 of FIG. 5 in accordance with some embodiments of the present disclosure.

Spring 234, illustrated in FIG. 3, provides a resistive force to the sleeve 186 through the spring driver 210. The spring 234 of the illustrated embodiment is mounted onto the hub 230 and engaged with the spring driver 210, and arranged to resistively slip around the hub 230 in the extension direction 198. The spring 234 may be located radially between the hub 230 and a wall 238 of the spring driver 210 and axially between a flange 238 of the hub 230 and the end wall 218 of the spring driver 210. The spring 234 of the illustrated embodiment includes a first tang 250, a second tang 254, and multiple windings formed between the tangs 250, 254. The first tang 250 of the illustrated embodiment is coupled to the spring driver 210 so that the first tang 250 moves substantially in unison with the spring driver 210. The illustrative first tang 250 extends outwardly from the windings transversely to the longitudinal axis 226 of the brake assembly 134. Referring to FIGS. 4 and 7, the illustrative first tang 250 of the spring 234 extends through an axially-extending opening or window 258 formed in the wall 238 of the spring driver 210. The first tang 250 may contact opposing edges of the wall 238 defining the window 258 such that the first tang 250 moves substantially in unison with the spring driver 210 about the hub 230. The second tang 254 may extend in a substantially helical path consistent with the windings of the spring 234. The spring 234 of the illustrated embodiment is formed as a torsion spring and may be referred to as a wrap spring. Other spring configurations are within the scope of the disclosure.

The hub 230, illustrated in FIGS. 3 and 6, is received within an interior space 262 defined by the spring driver 210 and includes an outer bearing surface 266 for supporting the spring 234. The hub 230 of the illustrated embodiment is non-rotationally mounted onto the shaft 142. The illustrative hub 230 may be keyed onto the shaft 142 so that the hub 230 is not rotatable relative to the shaft 142. In the embodiment illustrated in FIG. 3, keying of the hub 230 onto the non-rotatable shaft 142 is accomplished by an inner surface 270 of the illustrative hub 230 having a non-circular profile corresponding to a V-notched profile of the shaft 142. The inner surface 270 of the hub 230 of the illustrated embodiment has a V-shaped projection for seating in a V-shaped groove of the shaft 142 to restrict rotation of the hub 230 relative to the shaft 142. Other hub and shaft configurations are within the scope of the disclosure.

Spring driver 210, illustrated in FIG. 3, defines an interior space 262 for receiving the hub 230 and the spring 234. The illustrative spring driver 210 includes one or more latch fingers 274 that retain the hub 230 in the interior space 262 of the spring driver 210. The latch fingers 274 may form part of an axially-extending wall 238 that at least partially defines the interior space 262 and restricts lateral movement of the hub 230 within the interior space 262. The latch fingers 274 may extend lengthwise along the longitudinal axis 226. The latch fingers 274 may include barbed ends 278 that are transversely displaceable relative to the longitudinal axis 226. Opposite the barbed ends 278, the latch fingers 274 may include fixed ends attached to, such as monolithically formed with, an end wall 218 of the spring driver 210 that is oriented transversely to the latch fingers 274. The end wall 218 extends radially inward from the axially-extending wall 238, and, along with the latch fingers 274, restricts axial movement of the hub 230 within the interior space 262. The illustrative end wall 218 may rotationally bear against the shaft 142 and may be positioned axially between the hub 230 and the clutch 182. Other spring driver 210 configurations are within scope within the scope of the disclosure.

When the hub 230 is received in the interior space 262 of the spring driver 210, the barbed ends 278 of the latch fingers 274 may engage the hub 230 to axially constrain the hub 230 in the interior space 262. The hub 230 of FIG. 3 may include a flange 238 extending around a periphery of and projecting radially outward from the bearing surface 266 of the hub 230. The barbed ends 278 of the latch fingers 274 of the spring driver 210 may engage the flange 238 of the hub 230 to constrain the hub 230 in the interior space 262 of the spring driver 210. With reference to the illustrative embodiment of FIG. 4, the barbed ends 278 of the latch fingers 274 may overlap the flange 238 of the hub 230 to axially secure the hub 230 within the interior space 262 of the spring driver 210. The end wall 218 and the flange 238 may restrict axial movement of the spring 234 relative to the hub 230 within the interior space 262 of the spring driver 210. Other configurations are within the scope of the disclosure.

FIG. 7 is a transverse sectional view of an illustrative embodiment of the brake assembly 134. During rotation of the roller 126 (see FIG. 2) in the retraction direction 190, the roller drivingly rotates the brake driver 138 and the clutch 182 about the sleeve 186 (see FIG. 6) in the retraction direction 190. The clutch 182 spins in a relatively unrestricted manner about the sleeve 186 (see FIG. 6) in the retraction direction 190, thereby not transferring resistance from the spring driver 210 to the brake driver 138 because the clutch 182 rotates with respect to the sleeve 186 in the retraction direction 190. The spring driver 210 may be restricted from movement in the retraction direction 190, but such restriction does not affect the brake driver 138 because the brake driver 138 rotates with respect to the sleeve 186 in the retraction direction 190 and thus is not affected by restrictions to movement of the spring driver 210 in the retraction direction 190.

During rotation of the roller 126 in the extension direction 198, the roller 126 of FIG. 2 drivingly rotates the brake driver 138 and the clutch 182 in the extension direction 198. As previously discussed, the clutch 182 of the illustrated embodiment is not rotatable relative to the sleeve 186 in the extension direction 198 and thus the spring driver 210, which is non-rotatably coupled to the sleeve 186 can drivingly rotate the clutch 182 in the extension direction 198. The spring 234 of the illustrated embodiment is arranged to resistively slip about the hub 230 in the extension direction 198, thereby providing a resistive force that opposes rotation of the roller 126 in the extension direction 198 (via a resistive force imparted to the brake driver 138 via the sleeve 186 and the spring driver 210 via the spring 234). Upon rotation of the brake driver 138 in the extension direction 198, the spring driver 210 drives the tang 250 of the spring 234 in the extension direction 198 and radially expands the spring 234 relative to the hub 230, thereby forcing the spring 234 to resistively slip around the hub 230 in the extension direction 198. The slippage of the spring 234 around the hub 230 creates a resistive force that opposes rotation of the brake driver 138 in the extension direction 198. The resistive force applied to the brake driver 138 by the spring 234 provides a supplemental brake force that is sufficiently large in magnitude to overcome gravity and to hold the shade member 122 in a desired extended position yet is sufficiently small in magnitude to permit extension of the shade member 122 by application of an extension force thereto, such as by a drive mechanism of the covering.

FIGS. 11-14 illustrate an exemplary embodiment of a brake assembly used in association with a stacking shade. Covering 310, illustrated in FIG. 11, includes a head rail 314, a movable rail 318, and a shade member 322 extending between the head rail 314 and the movable rail 318. The rail 318 of the illustrative embodiment is coupled to a lower edge of the shade member 322 and functions as a ballast to maintain the shade member 322 in an extended configuration. A front cover of the illustrative head rail 314 is not shown in FIG. 11. As shown in the illustrative embodiment of FIG. 11, the covering 310 includes one or more rotatably-driven rods or shafts 323 attached respectively to lift and tilt cords to lift and tilt slats 325 of the shade member 322. The basic structure of covering 310 is described in U.S. Pat. No. 6,968,884 B2, which is hereby incorporated by reference herein in its entirety for all purposes.

Figure 11:
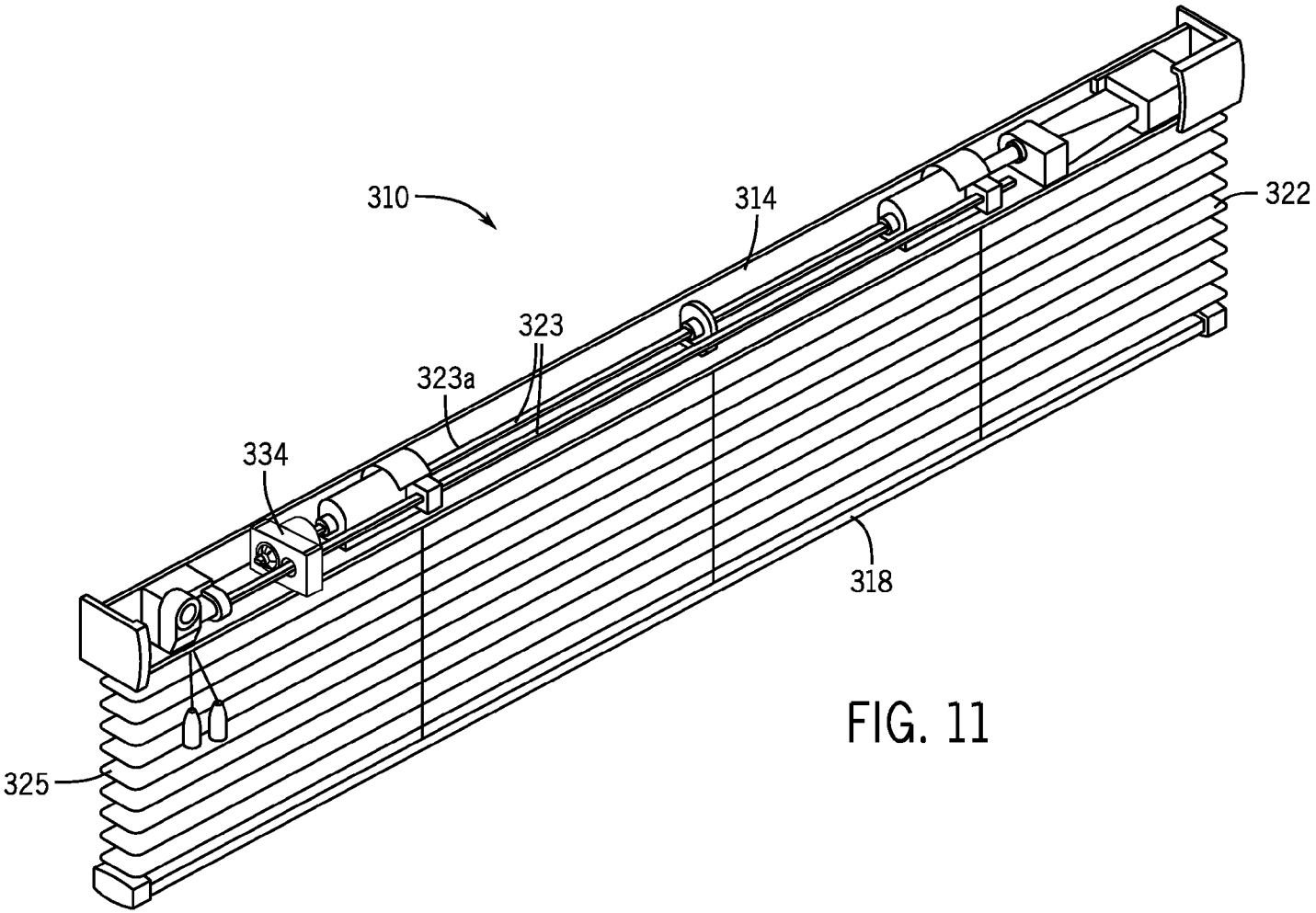
FIG. 11 is an isometric view of a covering for an architectural opening, such as a window opening, in accordance with some embodiments of the present disclosure.

With continued reference to FIG. 11, the covering 310 of the illustrated embodiment includes a brake assembly 334. The illustrative brake assembly 334 is stationarily mounted in the head rail 314 and receives a rotatably-driven shaft **323*a*. The brake assembly 334 of the illustrative embodiment resists rotation of the driven shaft 323*a* in an extension direction to retain the shade member 322 in a desired extended position. During retraction of the shade member 322, the illustrative brake assembly 334 permits relatively free rotation of the driven shaft 323*a* in a retraction direction. In other words, during retraction of the shade member 322, the brake assembly 334 of the illustrative embodiment provides preferably little to no resistance to rotation of the driven shaft 323*a***.

Figure 12:
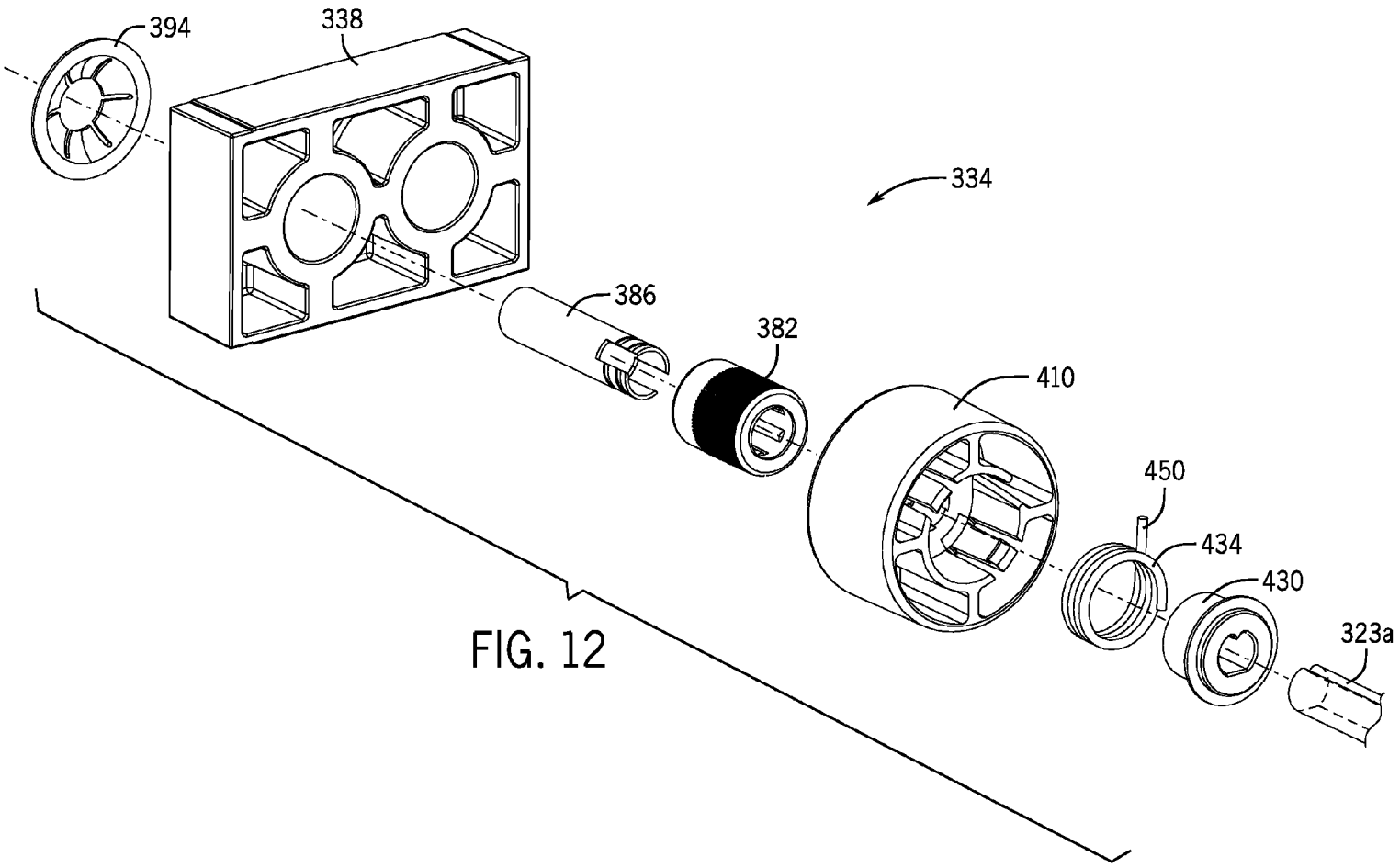
FIG. 12 is an exploded view of another exemplary embodiment of a brake assembly.
Figure 13:
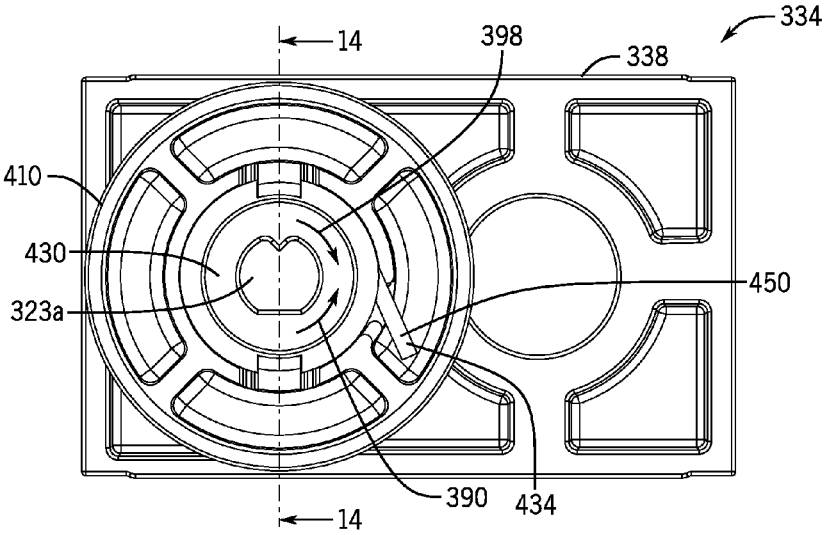
FIG. 13 is an end view of the brake assembly of FIG. 12 in accordance with some embodiments of the present disclosure.
Figure 14:
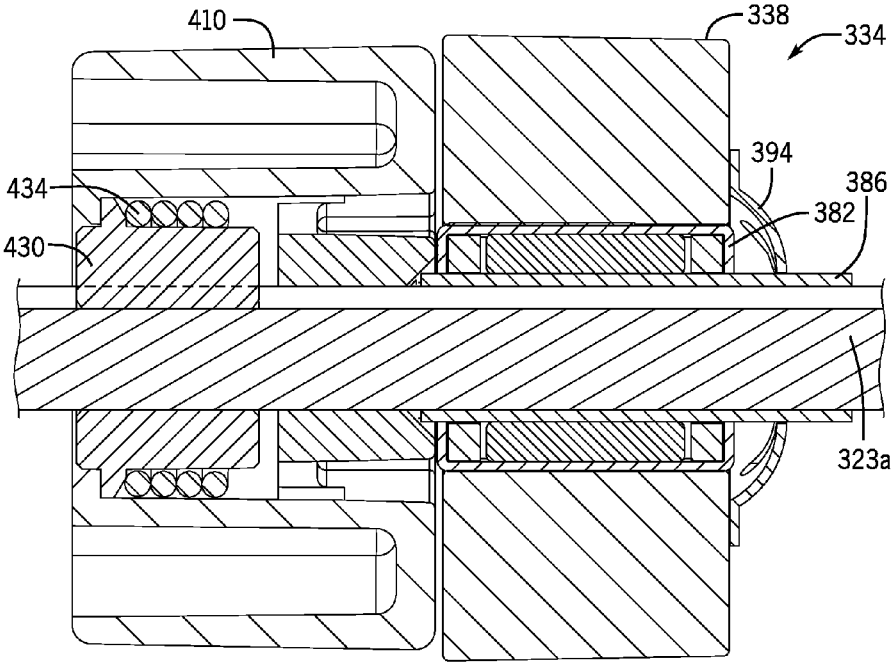
FIG. 14 is a lengthwise sectional view of the brake assembly of FIG. 12 taken along section line 14-14 of FIG. 13 in accordance with some embodiments of the present disclosure.

Brake assembly 334, illustrated in FIGS. 12-14, is similar to the brake assembly 134 of FIGS. 2-8. Accordingly, the preceding discussion related to the brake assembly 134 is applicable to the brake assembly 334 shown in FIGS. 12-14, except as noted below. The reference numerals used in FIGS. 12-14 are incremented by two-hundred relative to the reference numerals used in FIGS. 2-8 to reflect similar components and features.

Similar to the brake assembly 134 of the illustrative embodiment of FIGS. 2-8, the brake assembly 334 of the illustrative embodiment of FIGS. 12-14 may include a brake driver 338, a unidirectional bearing or clutch 382, a sleeve or hollow shaft 386, a spring driver 410, a hub 430, a spring 434, and a fastener 394. In contrast to the illustrative brake assembly 134 of FIGS. 2-8, the illustrative brake assembly 334 is not adapted for use with a roller shade. Rather, as shown in FIGS. 11-14, the illustrative brake assembly 334 is adapted for use with non-roller shades. The brake driver 338 of the illustrative embodiment is fixedly attached to the head rail 314 such that the brake driver 338 is not rotatable relative to the head rail 314.

Referring to FIG. 13, the shaft **323*a* is adapted to drivingly rotate the hub 430 in the retraction direction 390 during retraction of the shade member 322. The spring driver 410 rotates substantially in unison with the hub 430** by way of the spring 434. The tang 450 of the spring 434 drives the spring driver 410 in the retraction direction 390. The spring driver 410 of the illustrated embodiment is non-rotatably attached to the sleeve 386, and thus the spring driver 410 and the sleeve 386 rotate in unison with each other. The clutch 382 of the illustrative embodiment is arranged such that it permits relatively free rotation of the sleeve 386 in the retraction direction 390. The relatively free spinning of the bearing 382 about the sleeve 386 (see FIG. 14) in the retraction direction 390 provides preferably little to no resistance to rotation of the shaft 323*a* in the retraction direction 390, thereby not increasing the torque load on a drive mechanism of the covering during retraction of the shade member 322 (see FIG. 11).

With continued reference to FIG. 13, the shaft 323*a* is adapted to drivingly rotate the hub 430 in the extension direction 398 during extension of the shade member 322. The clutch 382 of the illustrated embodiment is non-rotationally coupled to the fixed brake driver 338 and is rotationally locked in the extension direction 398, thereby restricting the sleeve 386 and the spring driver 410 from rotating in the extension direction 398. As the hub 430 is rotated in the extension direction 398, the spring driver 410 restricts the tang 450 of the spring 434 from rotating in the extension direction 398, causing the spring 434 to radially expand relative to the hub 430, thereby permitting the shaft 323*a* and the hub 430 to rotate in the extension direction 398 against a slip resistance of the spring 434. The slip resistance of the illustrative spring 434 is sufficient to supplement a holding torque of a counterbalance device of the covering 310 and to retain the shade member 322 in a desired extended position once a force to extend the shade member 322 is removed therefrom.

Referring generally back to the embodiments of FIGS. 1-14, a method of assembling a covering for an architectural opening is provided. The method includes positioning a torsion spring 234, 434 about a hub 230, 430. The method includes coupling the torsion spring 234, 434 to a spring driver 210, 410. The method includes coupling the spring driver 210, 410 to a sleeve 186, 386 such that the spring driver 210, 410 is not rotatable relative to the sleeve 186, 386. The method includes coupling a clutch 182, 382 to a brake driver 138, 338 such that the brake driver 138, 338 rotates in unison with the unidirectional clutch 182, 382. The method includes coupling the clutch 182, 382 to the sleeve 186, 386 such that the brake driver 138, 338 is rotatable relative to the sleeve 186, 386 in a retraction direction and is not rotatable relative to the sleeve 186, 386 in an extension direction. The method may include radially expanding the spring 234, 434 about the hub 230, 430 in the extension direction. The method may further include radially constricting the spring 234, 434 about the hub 230, 430 in the retraction direction. The method may include inserting the brake driver 138 at least partially within an interior space of a roller 126 and coupling the brake driver 138 to the roller 126 such that the brake driver 138 rotates in unison with the roller 126. The method may include mounting the sleeve 186, 386 onto a shaft 142 such that the sleeve 186, 386 is rotatable relative to the shaft 142. The method may further include mounting the hub 230, 430 onto the shaft 142 such that the hub 230, 430 is not rotatable relative to the shaft 142.

The foregoing description has broad application. It should be appreciated that the concepts disclosed herein may apply to many types of shades, in addition to the shades described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A covering for an architectural opening, said covering comprising:

a first housing configured for coupling with a shade member;

a sleeve;

a second housing non-rotatably coupled with said sleeve; and a spring received within an interior space within said second housing;

wherein:

said first housing is operatively coupled with said sleeve to be rotatable relative to said sleeve in a first direction and non-rotatable relative to said sleeve in a second direction opposite said first direction; and said spring imparts rotational resistance to rotation of said second housing in said second direction, thereby imparting rotational resistance to rotation of said first housing in said second direction.

2. The covering of claim 1, further comprising a hub received within an interior space defined by said second housing, wherein said spring is coupled with said hub and said second housing.

3. The covering of claim 2, further comprising a shaft, wherein said hub is non-rotatably coupled with said shaft.

4. The covering of claim 3, wherein said shaft is stationary.

5. The covering of claim 3, wherein said shaft is rotatable.

6. The covering of claim 1, wherein said first housing and said second housing are axially aligned with each other.

7. The covering of claim 1, wherein said first housing has a larger outer dimension than said second housing for engaging a roller without the roller engaging said second housing.

8. The covering of claim 1, further comprising an adapter non-rotatably coupled with said first housing to increase an outer dimension of said first housing.

9. The covering of claim 1, further comprising a rotatable roller coupling said first housing with the shade member, wherein:

said first housing and said second housing are received within an interior space defined by said roller; and said first housing is keyed to said roller such that said first housing rotates in unison with said roller.

10. The covering of claim 1, further comprising a clutch coupled with said first housing for rotation therewith, and coupled with said sleeve to be rotatable relative to said sleeve in said first direction and non-rotatable relative to said sleeve in said second direction opposite said first direction.

11. The covering of claim 1, wherein:

said spring comprises a torsion spring;

said torsion spring is radially constricted and restricts rotation of said first housing in said first direction via said second housing and said sleeve; and said torsion spring is radially expanded and resistively permits rotation of said first housing in said second direction via said second housing and said sleeve.

12. A brake assembly for an architectural opening, said brake assembly comprising:

a shaft;

a sleeve coupled with said shaft;

a spring driver coupled with said sleeve such that said spring driver rotates in unison with said sleeve;

a hub non-rotatably coupled with said shaft and received within an interior space defined by said spring driver;

a spring coupled with said spring driver and said hub such that rotation of said spring driver relative to said hub in a first direction causes said spring to radially constrict about said hub and rotation of said spring driver relative to said hub in a second direction causes said spring to expand about said hub;

a clutch coupled with said sleeve; and a brake driver non-rotatably coupled with said clutch.

13. The covering of claim 12, wherein said clutch is freely rotatable relative to said sleeve in a first direction corresponding to radial constriction of said spring, and is not rotatable relative to said sleeve in a second direction corresponding to radial expansion of said spring.

14. The covering of claim 12, wherein said clutch and said hub are axially aligned with each other.

15. The covering of claim 12, wherein said spring driver imparts rotational resistance to rotation of said brake driver in said second direction.

16. A method of assembling a covering for an architectural opening, said method comprising:

coupling a clutch to a first housing such that the first housing rotates in unison with the clutch;

coupling the clutch to a sleeve such that the first housing is rotatable relative to the sleeve in a first direction and is non-rotatable relative to the sleeve in a second direction opposite the first direction;

positioning a spring about a hub;

coupling the spring to a second housing; and coupling the second housing to the sleeve such that the second housing is non-rotatable relative to the sleeve.

17. The method of claim 16, further comprising radially constricting the spring about the hub in the first direction and radially expanding the spring about the hub in the second direction.

18. The method of claim 16, further comprising inserting the first housing at least partially within an interior space of a roller, and coupling the first housing to the roller such that the first housing rotates in unison with the roller.

19. The method of claim 16, further comprising coupling the sleeve to a shaft such that the sleeve is rotatable relative to the shaft.

20. The method of claim 19, further comprising coupling the hub to the shaft such that the hub is non-rotatable relative to the shaft.

21. The method of claim 18, further comprising coupling a shade to the roller to extend into an extended position covering the architectural opening when the first housing rotates in the second direction, and to retract into a retracted position when the first housing rotates in the first direction.

22. The covering of claim 1, wherein:

said spring is operatively coupled with said second housing such that said spring resists rotation of said second housing in said second direction; and said resistance is transferred to said first housing in said second direction via said sleeve.

* * * * *